US007421972B1

(12) United States Patent
Long

(10) Patent No.: US 7,421,972 B1
(45) Date of Patent: Sep. 9, 2008

(54) FLAG RETAINING DEVICE

(76) Inventor: Kim K. Long, 8201 Camelot Dr., Harrisburg, NC (US) 28075

( * ) Notice: Subject to any disclaimer, the term of this patent is extended or adjusted under 35 U.S.C. 154(b) by 0 days.

(21) Appl. No.: 11/553,812

(22) Filed: Oct. 27, 2006

(51) Int. Cl.
*G09F 17/00* (2006.01)

(52) U.S. Cl. ..... 116/173; 24/508

(58) Field of Classification Search ..... 116/173, 116/174, 28 R; 24/3.1, 3.11, 508, 511; 40/607.03, 40/607.09, 611.01, 617; 428/28; D11/166, D11/181, 182
See application file for complete search history.

(56) References Cited

U.S. PATENT DOCUMENTS

| | | | | | |
|---|---|---|---|---|---|
| 695,663 | A | * | 3/1902 | Weirich | 116/173 |
| 1,748,625 | A | * | 2/1930 | Troth | 116/173 |
| 2,447,075 | A | * | 8/1948 | Madsen | 116/173 |
| 2,799,240 | A | | 7/1957 | Andrews | |
| 3,587,520 | A | * | 6/1971 | Miller | 116/173 |
| 4,103,642 | A | * | 8/1978 | Swenson | 116/174 |
| 4,559,675 | A | * | 12/1985 | Devenny | 24/5 |
| 5,400,737 | A | * | 3/1995 | Salazar | 116/174 |
| D374,170 | S | | 10/1996 | Slaski | |
| D403,617 | S | * | 1/1999 | Zeese | D11/181 |
| 5,943,980 | A | * | 8/1999 | Huang | 116/174 |
| 5,975,009 | A | | 11/1999 | Nihra et al. | |
| 6,223,399 | B1 | * | 5/2001 | Chen | 24/3.1 |
| 6,402,116 | B1 | | 6/2002 | Northup | |
| 6,748,896 | B2 | * | 6/2004 | Hunsley | 116/173 |
| 7,086,346 | B1 | * | 8/2006 | Van Horn et al. | 116/173 |
| 2003/0200912 | A1 | | 10/2003 | Brock, Jr. | |
| 2005/0172884 | A1 | | 8/2005 | Hlavin | |
| 2006/0065182 | A1 | * | 3/2006 | Campbell et al. | 116/174 |

FOREIGN PATENT DOCUMENTS

| | | | |
|---|---|---|---|
| FR | 2844631 | A1 * | 3/2004 |
| JP | 08272303 | A * | 10/1996 |
| JP | 10020820 | A * | 1/1998 |
| JP | 2002358037 | A * | 12/2002 |
| JP | 2002358038 | A * | 12/2002 |

* cited by examiner

*Primary Examiner*—R. A. Smith
(74) *Attorney, Agent, or Firm*—Advantia Law Group; Michael W. Starkweather; Jason P. Webb

(57) ABSTRACT

A flag retaining device for keeping a flag in place. The device includes: a flag pole member, having two ends; a flag banner member, coupled to the flag pole member; and a clamp member, removably coupled to the flag banner member. The clamp member includes: a first elongated member and a second elongated member, each having two ends, and a middle portion substantially between the ends; a pivot mechanism in the form of a spring, pivotally coupled to the middle portion of the elongated members; and a cap member, removably coupled to the first and second elongated members by sliding, and having a cavity sized to correspond to the third end of the first elongated member.

6 Claims, 3 Drawing Sheets

FLAG RETAINING DEVICE

BACKGROUND OF THE INVENTION

1. Field of the Invention

The present invention relates to flag retaining devices, specifically a flag retaining device for keeping a flag in place.

2. Description of the Related Art

In the related art, it has been known to use device to secure flags to poles to prevent unraveling, furling and/or damage to such. People display various flags on poles. Such if outdoors will likely be subject to wind and other forces that will cause unraveling, furling and/or other damage. Therefore there is a need to effectively, easily, and affordably secure flags to poles and further prevent said damage. Some improvements have been made in the field. Examples include but are not limited to the references described below, which references are incorporated by reference herein:

U.S. Pat. No. 5,975,009, issued to Nihra et al., discloses a flag retaining mechanism including a telescopic pole and a pair of improved retainer clips for retaining the flag in a fixed location on the pole. Each clip includes a full circle ring for gripping a pole, first and second legs diverging from the ring, a bend formed on the end of the first leg, an extension extending laterally from the bend toward the second leg to provide a flag support segment, and interconnectable hooks formed on the distal ends of the extension and the second leg to prevent the segment and leg from separating while a flag is mounted thereon.

U.S. Pat. No. 6,402,116, issued to Northup, discloses a flag holder allows the mounting of a flag to a support pole without puncturing the flag. A dowel is first inserted into a channel formed along an edge of the flag. Next, a generally cylindrical sleeve is inserted over the dowel, and over the flag. A slit extending along the length of the sleeve allows the flag to pass through the slit so as to hang freely. Finally, a support pole having a threaded end is screwed into a threaded opening formed in, or connected to, the sleeve. As the support pole is screwed in, its end comes into abutment with the flag, and holds the flag firmly against the dowel. The flag therefore cannot slide along the dowel again, until the support pole is unscrewed. The flag is thus held by friction and pressure, but not with any nail or other puncturing fastener.

U.S. Pat. No. 2,799,240, issued to Andrews, discloses flag mountings.

U.S. Patent Application Publication No.: 2003/0200912, by Brock, discloses a golf flag pin retrieval device is a wheel, preferably made of plastic that is threaded to the top of a golf flag pin. The wheel is of such diameter that a putter head may be placed under the pin adjacent in the gap made between the ground and the wheel. The upper end of the golf flag pin may then be easily lifted up by lifting the club until the upper portion of the pin may be grasped by the golfer. The wheel has a hub having threaded taps of two sizes through opposing hub faces to allow the screwing on of the wheel device to either of two standard threaded golf flag pins. The retrieval device replaces the cap nut which is commonly used to retain the flag to the pin.

U.S. Patent Application Publication No.: 2005/0172884, by Hlavin, discloses a decorative residential or commercial flag for attachment to a supporting upright pole having flag attachment means comprising a linear sleeve adapted to loosely slip over the upright pole to enable unobstructed rotation of the flag in response to wind direction along with a flexible tab secured to the top of the linear sleeve adapted to rotatably engage an upwardly extending narrow pin located at the top of the upright pole. The flexible tab contains an opening larger than the narrowed upright extension to enable free rotation of the tab around the narrowed extension, while the opening is smaller than the upright pole to enable the larger diameter pole to vertically support the flexible tab. The flexible tab supports the decorative flag vertically on the upright pole while the sleeve enables circumferential rotation of the decorative flag about the axis of the upright pole. The decorative flag can be attached directly to an upright pole or inclined pole. Preferred flags are outdoors flags supported vertically by inserting the bottom end of the pole into a ground socket sunk into the ground flush with the ground, which permits expedient installation of the flag pole and easy removal of the pole for storage or rearrangement if desired. Alternatively the flagpole can be supported by a weighted holder resting on interior furniture or floors, or outside on a patio or other flat surface.

U.S. Design Patent No.: 374,170, issued to Slaski, discloses the ornamental design for the shower curtain clip with magnetic/weight insert.

The inventions heretofore known suffer from a number of disadvantages which include costly, unreliable, limited in use, inconvenient, and/or otherwise fail to effectively secure flags to poles in an attractive manner.

What is needed is a flag retaining device that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available flag retaining devices. Accordingly, the present invention has been developed to provide a flag retaining device for keeping a flag in place.

In one embodiment, there is a flag retaining device for keeping a flag in place that may include: a flag pole member, that may have a first end and/or a second end; and/or a flag banner member, that may be coupled to the flag pole member near the second end of the flag pole; and/or a clamp member, that may be removably coupled to the flag banner member near an end opposite the second end of the flag pole.

An embodiment of the clamp member may further include: a first elongated member, that may have a third end and/or a fourth end, and/or may have a first middle portion that may be substantially between the third and/or fourth ends; a pivot mechanism that may be in the form of a spring, and/or may be pivotally coupled to the middle portion of the first elongated member; and/or a second elongated member, having a fifth end and a sixth end, having a second middle portion that may be substantially between the fifth and/or sixth ends, and/or may be pivotally coupled to the pivot mechanism near the second middle portion; and/or a cap member, that may be removably coupled to the first elongated member by sliding, and/or may have a cavity that may be sized to correspond to the first elongated member.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
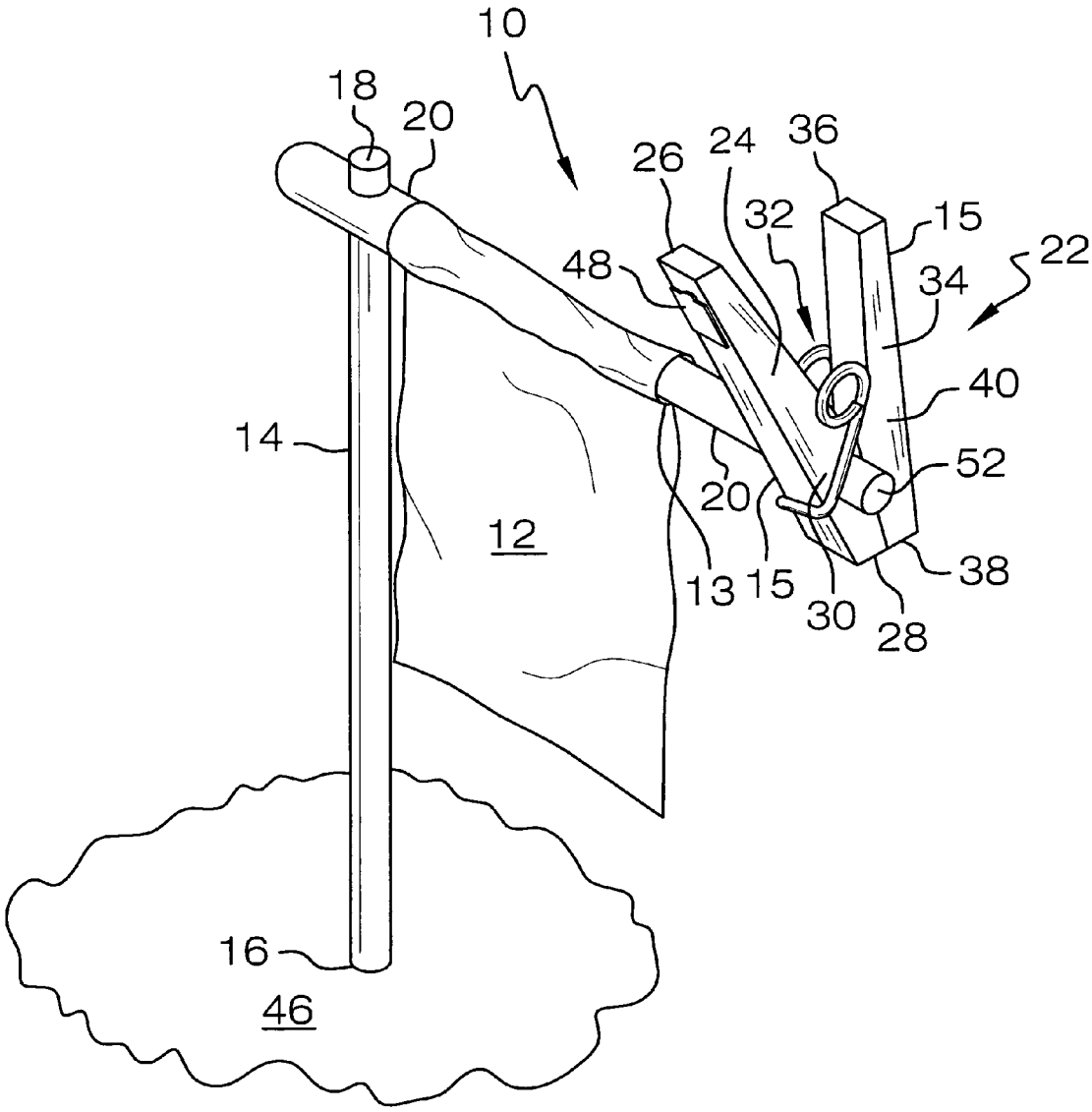
FIG. 1 is a perspective view of a flag retaining device keeping a flag in place, according to one embodiment.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

FIG. 1 illustrates a perspective view of a flag retaining device 10 for keeping a flag 12 in place. The illustrated embodiment includes: a flag pole member 14, having a first end 16 and second end 18; a flag banner member 20 coupled to the flag pole member (also referred to as flag pole) near the second end of the flag pole; and clamp member 22 removably coupleable to the flag banner member near an end 52 opposite the second end of the flag pole member; and serves as a means to retain the flag thereon. A user may mount the end 16 of the flag pole member into a ground or surface 46.

The clamp member 22, as shown FIG. 1, further includes: a first elongated member 24, having a third end 26 a fourth end 28, a track mechanism 48 disposed thereon, and a first middle portion 30 substantially between ends 26, 28; a pivot mechanism 32, in the form of a spring, pivotally coupleable to the middle portion 30; and a second elongated member 34, having a fifth end 36 and sixth end 38. The elongated member 34 also has a second middle portion 40 substantially between the ends 36, 38, and is pivotally coupleable to the pivot mechanism (also referred to as a spring) near the second middle portion. The spring is configured to provide enough tension to keep the middle portions 30, 40 of the elongated members 24, 34 mated together, unless a user grabs and squeezes the ends 26 36 of the elongated members, thereby compressing the spring to disengage the elongated members 24, 34 from each other. A non-limiting example of a clamp member may include a Giant Clothespin, Great Big Stuff, Inc., 116 Sleepy Hollow Drive, Suite C, Middletown, Del. 19709.

Figure 2:
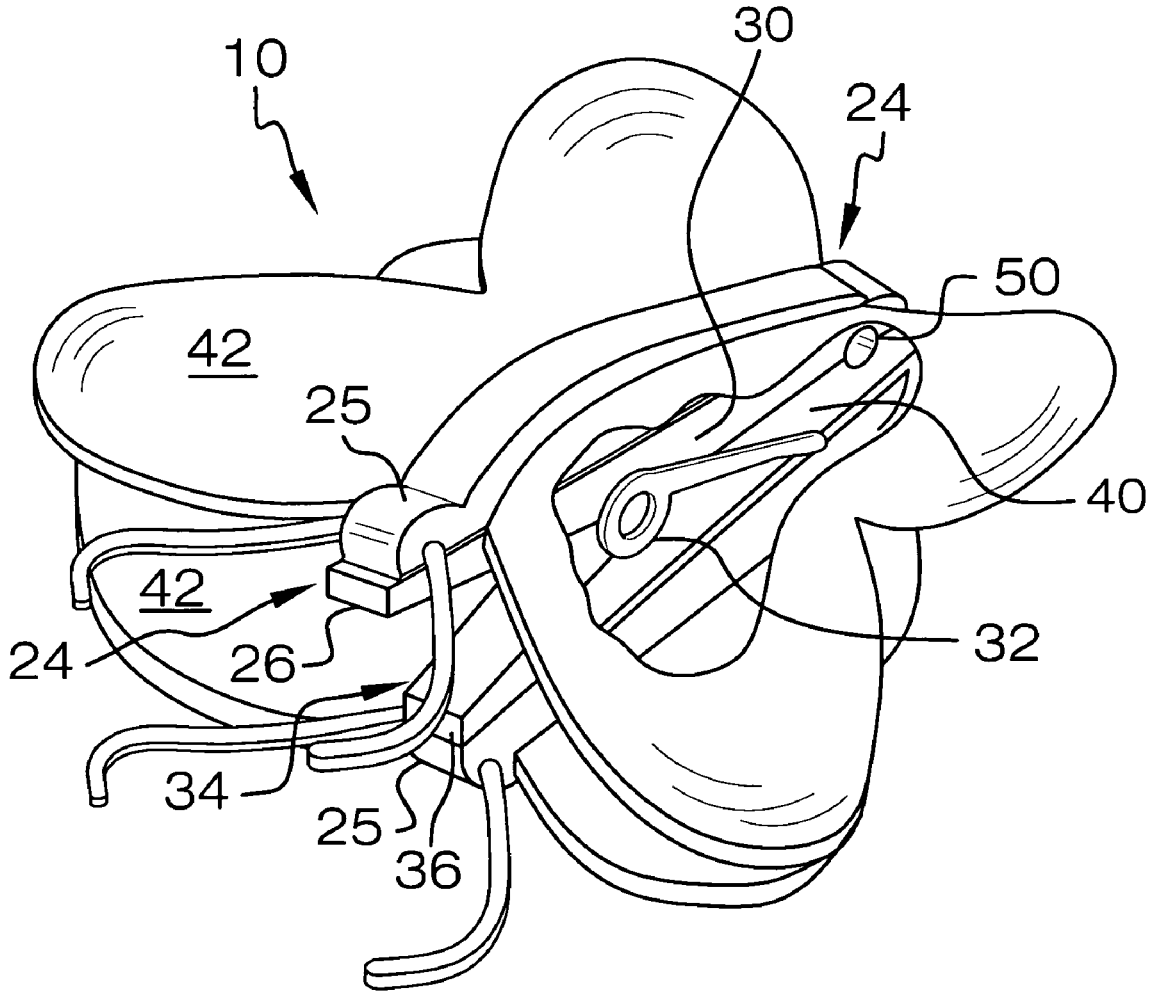
FIG. 2 is a cutaway perspective view of a flag retaining device, according to one embodiment.
Figure 3:
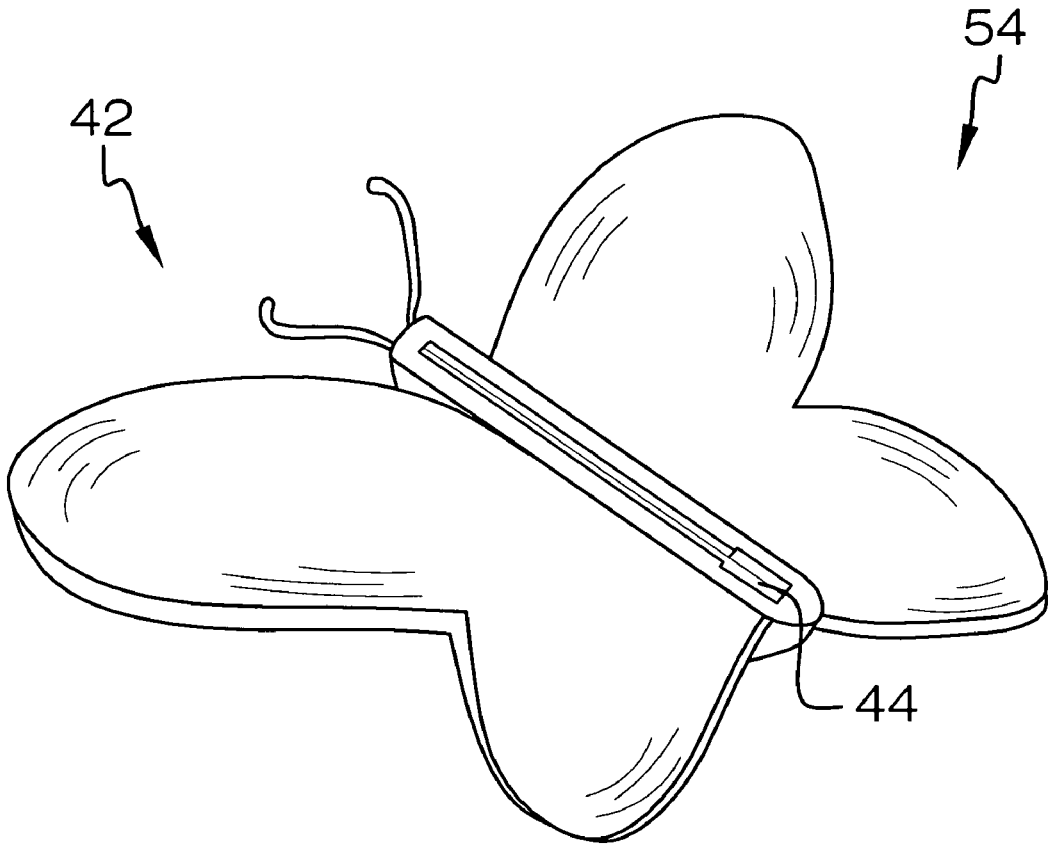
FIG. 3 is a bottom perspective view of a flag retaining device cap member, according to one embodiment.

As shown in FIGS. 2 and 3, there is also a cap member 42, in the form of a butterfly, removably and slidably coupled to elongated member 24 of the device 10. In addition, the cap member has a cavity 44 configured to be sized to correspond to a track mechanism 48 fixedly disposed on elongated member 24. The track mechanism 48 is configured to be removably inserted into the cavity 44 on the bottom side 54 of the cap member 42. This enables the cap member to be slidably coupled to elongated member 24. In alternative embodiments, the cap member may in the form of other decorative figurines, such as: flowers, sports figures, etc. Further, the device may include a plurality of cap members 42, each coupled to the side 15 of elongated members 24, 34 such that the head 25 of the cap member 42 is positioned near the ends 26, 36 of elongated members 24, 34, as shown in FIG. 2, according to various embodiments.

In operation of the present invention, a user desiring to retain a flag posted on a flag pole 14 mounted into the ground 46 during windy or stormy days, may slide flag banner member 20 through the flag aperture 13. The user could then squeeze the ends 26, 36 of elongated members 24, 34, to compress the spring 32; thereby disengaging the middle portion 30 of elongated member 24 from the middle portion 40 of elongated member 34. The user may line up the semicircular grooves 50 in elongated members 24, 34 anywhere along the flag banner member 20 and release the elongated member ends 26, 36. This will enable the clamp member to clamp on to the flag banner member in the grooves 50 near elongated member ends 28, 38, thereby generating enough friction needed to prevent the flag 12 from sliding off of the flag banner member and/or blowing away from the user's property during windy or stormy weather conditions.

Embodiments of the flag retaining device 10 fulfill the need for a decorative clip to help prevent a flag from slipping off the end of a horizontal pole. The device could be utilized for outdoor decorating, gardening, and other events. The device could also be used at hotels, motels, etc.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

Although FIG. 1 illustrates the track mechanism 48 being disposed on a side 15 of elongated member 24, one skilled in the art would know the mechanism may be disposed on the side 15 of elongated member 34, according to various embodiments.

Additionally, although FIG. 1 illustrates the track mechanism 48 being disposed near the end 26 of the first elongated member 24, one skilled in the art would appreciate that the mechanism may be disposed on the first elongated member 24, or on the side 15 of both elongated members 24, 34, as well as anywhere on elongated members 24, 34, according to alternative embodiments.

Moreover, although FIG. 1 illustrates the clamp member being coupled to near the end 52 of flag banner member 20, the clamp member may be coupled to anywhere along the flag banner member to retain various dimensions of flags 12 thereon.

Moreover, although FIGS. 2 and 3 illustrate the cap member 42 as a butterfly, one skilled in the art would know that the cap member may be designed in a multitude of various forms, according to different embodiments. For example, flowers, sports figures, etc.

It is expected that there could be numerous variations of the design of this invention. An example is that the flag pole member 14; flag banner member 20; clamp member 22; elongated members 24, 34; middle portions 30, 40; spring 32; cap member 42; cavity 44; and/or track mechanism 48 may vary in size, length, width, thickness, design, shape, etc., according to various embodiments.

Finally, it is envisioned that the components of the device may be constructed of a variety of materials, such as plastic, wood, metal, etc.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A flag retaining device for keeping a flag in place, comprising:

a) a flag pole member, having a first end and a second end;

b) a flag banner member, coupled to the flag pole member near the second end of the flag pole;

c) a clamp member, removably coupled to the flag banner member near an end opposite the second end of the flag pole, having:

c1) a first elongated member, having a third end and a fourth end, and having a first middle portion substantially between the third and fourth ends;

c2) a pivot mechanism, pivotally coupled to the middle portion of the first elongated member; and c3) a second elongated member, having a fifth end and a sixth end, having a second middle portion substantially between the fifth and sixth ends, and pivotally coupled to the pivot mechanism near the second middle portion; and d) a cap member, removably coupled to the first elongated member and second elongated member, and having a cavity sized to correspond to a track mechanism of the first elongated member and second elongated member.

2. The flag retaining device of claim 1, wherein the pivot mechanism includes a spring.

3. The flag retaining device of claim 2, wherein the cap member is removably coupled to a side of the first elongated member and a side of the second elongated member by sliding.

4. A flag retaining device for keeping a flag in place, consisting essentially of:

a) a clamp member, removably coupleable to a flag on a flag pole, having:

a1) a first elongated member, having a first end and a second end, and having a first middle portion substantially between the first and second ends;

a2) a pivot mechanism, pivotally coupled to the middle portion of the first elongated member; and a3) a second elongated member, having a third end and a fourth end, having a second middle portion substantially between the third and fourth ends, and pivotally coupled to the pivot mechanism near the second middle portion; and b) a cap member, removably coupled to the first elongated member and second elongated member, and having a cavity sized to correspond to a track mechanism of the first elongated member and second elongated member.

5. The flag retaining device of claim 4, wherein the pivot mechanism includes a spring.

6. The flag retaining device of claim 4, wherein the cap member is removably coupled to a side of the of the first elongated member and a side of the second elongated member by sliding.

* * * * *